US006327995B1

(12) United States Patent
Meadows, II et al.

(10) Patent No.: US 6,327,995 B1
(45) Date of Patent: Dec. 11, 2001

(54) SIGNALLING METHOD AND APPARATUS

(75) Inventors: James L. Meadows, II, Washington, DC (US); Holly Briggs, Bethesda, MD (US)

(73) Assignee: Protocol Office Products, LLC., Washington, DC (US)

( * ) Notice: Subject to any disclaimer, the term of this patent is extended or adjusted under 35 U.S.C. 154(b) by 0 days.

(21) Appl. No.: 09/262,747

(22) Filed: Mar. 5, 1999

(51) Int. Cl.[7] ..... G09F 9/00
(52) U.S. Cl. ..... 116/306; 116/200; 434/433
(58) Field of Search ..... 116/306, 200, 116/201, 307, 309, 321; 446/125, 124, 396, 97; 273/154, 157 R, 153 P, 449, 276, 450; 434/211, 214, 215, 433; 473/386, 401, 387, 278

(56) References Cited

U.S. PATENT DOCUMENTS

| | | | | |
|---|---|---|---|---|
| 211,528 | * | 1/1879 | Shelton | 273/260 |
| 595,455 | | 12/1897 | Gidden . | |
| 1,216,840 | * | 2/1917 | Ramsey et al. | 446/116 |
| 1,895,611 | * | 1/1933 | Doak | 446/104 |
| 2,333,273 | | 11/1943 | Scanlon . | |
| 2,458,306 | * | 1/1949 | Schneider | 446/85 |
| 2,965,978 | | 12/1960 | Olson . | |
| 3,280,499 | | 10/1966 | Studen . | |
| 3,290,797 | | 12/1966 | Opel . | |
| 3,518,786 | * | 7/1970 | Holtvoigt | 273/450 |
| 3,708,910 | | 1/1973 | Skillman . | |
| 3,747,261 | * | 7/1973 | Salem | 434/403 |
| 3,780,695 | | 12/1973 | Richard . | |
| 4,107,870 | * | 8/1978 | Ausnit | 446/122 |
| 4,150,828 | * | 4/1979 | Marchese | 446/97 |
| 5,035,666 | | 7/1991 | Kang . | |
| 5,810,395 | | 9/1998 | Morgan . | |

* cited by examiner

*Primary Examiner*—Andrew H. Hirshfeld
(74) *Attorney, Agent, or Firm*—Lowe Hauptman Gilman & Berner, LLP

(57) ABSTRACT

A human subject signals his personal attitude characteristic to others by placing one of a red cube, yellow sphere or green tetrahedron in a more prominent position that the other objects. The cube and tetrahedron respectively include an upper face and a base with indentations formed as sectors of a sphere having the same radius of curvature as the sphere. The sphere can be stably placed in the cube indentation and the tetrahedron indentation can be stably placed on the sphere.

8 Claims, 4 Drawing Sheets

SIGNALLING METHOD AND APPARATUS

FIELD OF INVENTION

The present invention relates generally to a method of signalling personal attitude characteristics of a human subject and more particularly to such a method wherein the signalling is accomplished by placing objects having differing visually perceptible characteristics in a prominent place.

Another aspect of the invention relates to a signalling and/or novelty device including a stacked arrangement of separate objects including a parallelepiped, sphere and tetrahedron.

BACKGROUND ART

Decorum of modern office and other similar environments has in many instances declined to such an extent that personnel who are busily engaged in efforts requiring substantial concentration and/or who do not otherwise wish to be disturbed are nevertheless interrupted by conversation originating from other personnel. The interruptions occur in many different environments, for example, in large rooms where staff are closely situated and are separated by partitions between work stations occupied by individual workers, and in small rooms occupied by two or more persons. The interruptions frequently result in prolonged chit-chat between personnel, resulting in low productivity, and in many instances, poor morale. Managerial and professional workers who occupy individual rooms are also frequently interrupted by personnel who knock on closed doors and then barge into the room.

In addition, many office environments are quite drab, being equipped with battleship grey desks and light grey computer work stations. These drab surroundings frequently have an adverse effect on productivity because they cause subliminal depression in many workers. These conditions sometimes result in lack of a concerted team effort on the part of the personnel.

In some offices and other similar environments, "do not disturb" signs are used to signal the unwillingness of a worker to be interrupted. However, "do not disturb" signs may have an adverse effect on visitors to the location where they are displayed.

SUMMARY OF THE INVENTION

Accordingly, an object of the present invention is to provide a new and improved method of and apparatus for enabling a person to signal his personal attitude characteristics to others.

Another object of the present invention is to provide a new and improved method of and apparatus for enabling personnel in offices and other similar environments to signal to others whether or not they are willing to be interrupted at all, interrupted for important work oriented purposes, and/or open for interruption.

Another object of the present invention is to provide a new and improved signalling apparatus that can also be considered as a novelty device, wherein the apparatus includes several objects having different visually perceptible characteristics which also enhance the environment where the objects are located.

Another object of the invention is to provide a new and improved signalling device for office type environments, which signalling device can improve office morale and productivity because of its colorful and entertaining characteristics, leading to increased teamwork among co-workers.

A further object of the invention is to provide a new and improved office signalling device which effectively provides a coded signal to co-workers that a particular individual does not want to be disturbed, but which is not offensive to visitors.

In accordance with one aspect of the invention, a human subject signals his different personal attitude characteristics to others with a set of objects, each having a different visually perceptible characteristic. One of the objects is associated with each of the personal attitude characteristics. After the subject selects the behavioral characteristic to be signalled, he places the object so the object associated with the selected attitude characteristic is in a more prominent position for visual observation than the other objects. The prominent position can be on top of a desk or computer monitor where the subject works and can involve displaying only one object and sequestering the other objects out of the field of view of personnel.

The objects preferably have differing shapes, enabling the objects to be stacked on each other. In one embodiment of the method, the placing step comprises stacking the objects so the object associated with the selected attitude characteristic is at the top of the stack and thus is in a more prominent position for visual observation than the other objects.

In a preferred embodiment, first and second of the objects include substantially flat faces and a third of the objects has a curved outer surface. A region where the objects are to be placed has a substantially planar horizontal support surface. The placing step includes placing the substantially flat face of one of the objects including a flat face on the substantially horizontal support surface of the region.

The first object is preferably shaped as a parallelepiped (particularly a cube) and the second object has a base and sides tapered to a point. The placing step includes placing a flat face of the parallelepiped on the substantially horizontal support surface, placing the third object having the curved surface on the first object, and placing the base of the second object on the third object.

Preferably, all portions of the outer surface of the third object are curved and the parallelepiped has a flat face with a concave indentation. The base of the second object also has a concave indentation and the placing step includes placing: (a) the third object so the outer surface thereof rests in the concave indentation of the flat face of the parallelepiped, and (b) the second object so the concave indentation of its base rests on the third object.

Alternatively, the placing step includes placing the object associated with the selected attitude characteristic in a transparent container, to the exclusion of the other objects. In such a case, the placing step preferably includes placing the container on a door leading to a room where the subject is located, and then closing the door. When the method is performed in this manner, the selected behavioral characteristic is usually associated with "do not disturb" the subject. In such a case, the placing step usually includes hanging the container on a doorknob which is outside the room when the door is closed.

Another aspect of the invention relates to the combination of a first object having a base and a face substantially parallel to the base, a second object having a base and a side surface tapered to a point, and a third object having a curved outer surface. The objects are separate from each other but are sized and shaped so that the third object can rest stably on the face of the first body while the base of the first body rests on a substantially planar surface and the base of the second object can rest stably on the third object while the third object rests stably on the face of the first body while the base of the first body rests on a substantially planar support surface.

In the preferred embodiment, the third object is a sphere and the face of the first object has a concave indentation that is a sector of a sphere having substantially the same curvature as the sphere. The base of the second object has a concave indentation that is a sector of a sphere having substantially the same curvature as the sphere. The first, second and third objects are arranged so the sphere can rest (i.e., nest) stably without other support on the indentation of the first object in such a way that there is substantial contact between the surfaces of the sphere and the indentation of the first object and the indentation of the second object can rest stably without other support on the sphere in such a way that there is substantial contact between the surfaces of the sphere and indentation of the second object. Such construction assists in providing great stability to the stacked arrangement.

Preferably, the first and second objects are shaped as a cube and polyhedron. The cube, sphere and polyhedron are preferably made of the same material having a relatively high coefficient of friction. The size and shape of the sphere and polyhedron and the coefficient of friction are such that the polyhedron vertical axis can be displaced approximately 30° from the vertical when the base of the first object rests on the substantially planar horizontal support surface. The polyhedron base is preferably shaped as a square having sides and a height approximately equal in length to the sphere diameter, to assist in stably stacking the objects.

Each of the objects is preferably color coded, as well as being coded by shape as previously described. Such coding enables the subject to signal his different personal attitude characteristics to a selected group, e.g., co-workers, while others who are visitors will not realize the significance of the coded object.

Preferably, a transparent container simultaneously holds the first, second and third objects at the time the device is purchased. The transparent container can include a structure for enabling the container to be held in situ on a doorknob so a subject in a room behind a closed door including the doorknob can signal his behavioral characteristic by hanging the bag with one of the objects in it on the doorknob.

The objects are preferably made of a closed cell foam compressible plastic having a smooth surface texture with a pleasing tactile effect.

The above and still further objects, features and advantages of the present invention will become apparent upon consideration of the following detailed description of several specific embodiments thereof, especially when taken in conjunction with the accompanying drawings.

DETAILED DESCRIPTION OF THE DRAWING

Figure 1:
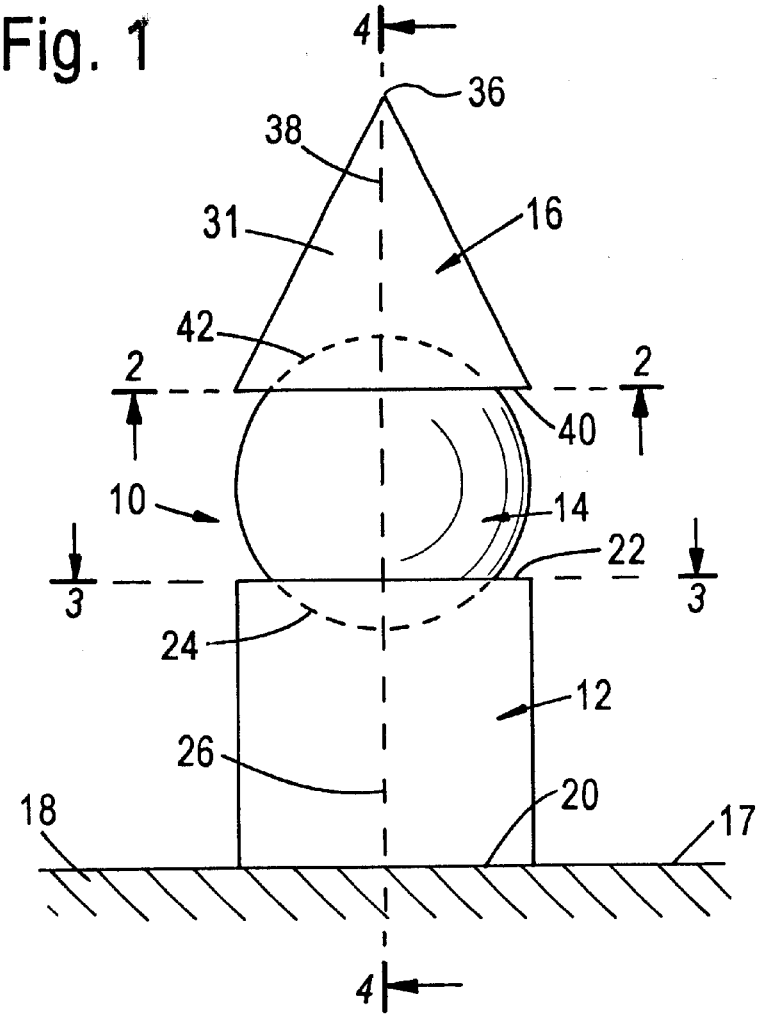
FIG. 1 is an elevation view of a preferred embodiment of a signalling/novelty device in accordance with the present invention.
Figure 2:
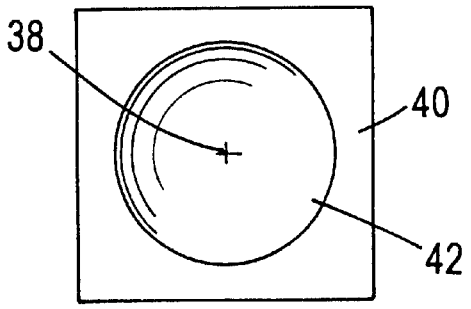
FIG. 2 is a bottom view of the tetrahedron illustrated in FIG. 1, taken along the lines 2—2.
Figure 3:
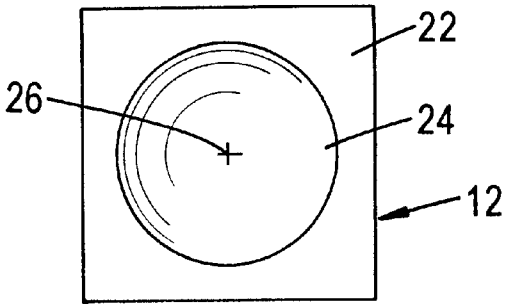
FIG. 3 is a top view of the cube illustrated in FIG. 1, taken along the lines 3—3.
Figure 4:
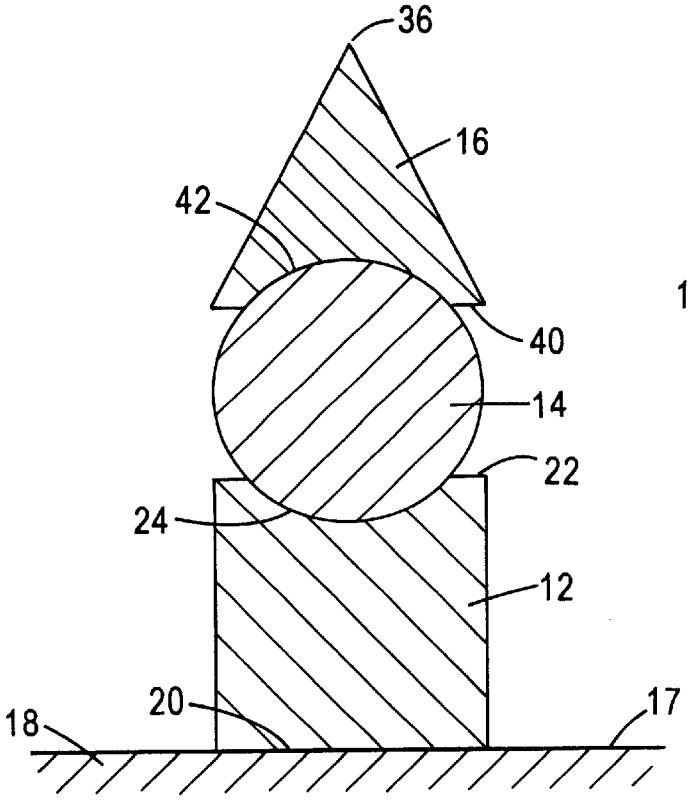
FIG. 4 is a cross-sectional view of the structure illustrated in FIG. 1, taken along the lines 4—4.
Figure 5:
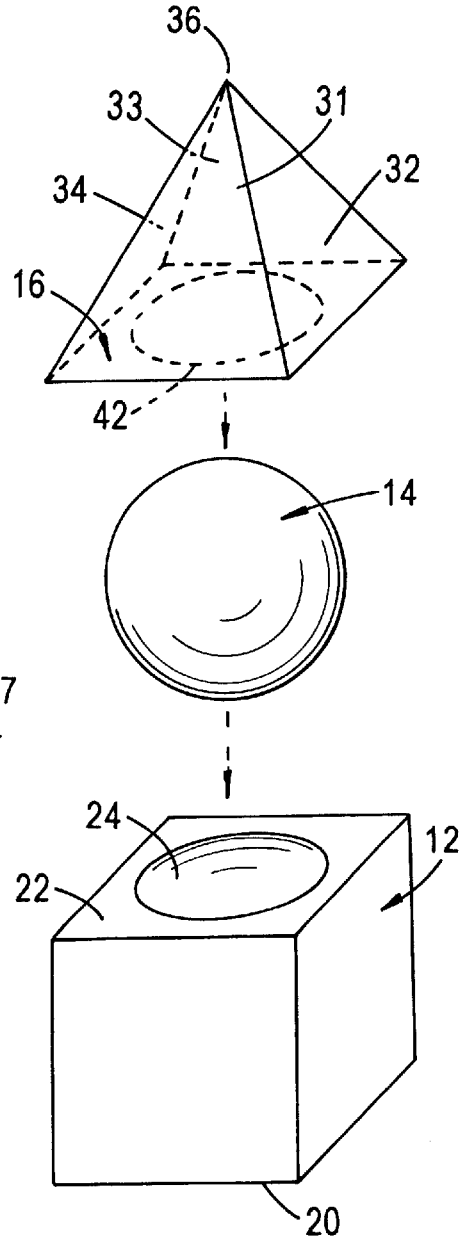
FIG. 5 is an exploded view of the structure illustrated in FIG. 1.

Reference is now made to FIGS. 1–5 of the drawing wherein a stacked structure 10, including cube 12 (i.e., a right parallelepiped having equal length sides), sphere 14 and pyramid or tetrahedron 16, is illustrated. Preferably, each of cube 12, sphere 14 and tetrahedron 16 is a foam polyurethane. The stacked arrangement is illustrated in FIGS. 1 and 4 as resting on horizontal support surface 17 of support member 18, e.g. a desk. Cube 12 has a planar base 20 resting on surface 17 and an upper face 22 including concave indentation 24 having the shape of a sector of a sphere with a 3.5 inch diameter. Indentation 24 is centrally located on face 22 so that the nadir of indentation 24 is coincident with vertical axis 26 of cube 12.

The depth of indentation 24 is sufficiently great to enable sphere 14 to be held stably in place in the indentation, while enabling the sphere to retain its general spherical appearance to an observer. In the preferred embodiment, for a sphere having a 3.5 inch diameter, the maximum depth of indentation 24 along vertical axis 26 of cube 12 is about 0.5 inch.

Tetrahedron 16 includes four mutually orthogonal vertically extending faces 31–34, which meet at apex 36 through which the tetrahedron vertical axis 38 extends. Vertical axis 38 also intersects the center of base 40 of tetrahedron 16. Base 40 includes indentation 42, having the shape of a sector of a sphere having a 3.5 inch diameter. The zenith of concave indentation 42 is coincident with axis 38. Indentation 42 has sufficient depth, preferably about one-half inch, to enable tetrahedron 16 to stably sit on sphere 14, while still preserving the round appearance of the sphere. Since the radius of curvature of sphere 14 is the same as the radius of curvature of indentations 24 and 42, the sphere exterior surface contacts virtually all portions of indentation 24 when the sphere is placed in indentation 24, and the exterior surface of the sphere also contacts virtually all portions of the surface of indentation 42 when base 40 of tetrahedron 16 is put on the sphere.

Each edge of cube 12 has a length equal to the diameter of sphere 14, which in turn is equal to the length of each edge of base 40 of tetrahedron 16. The height of tetrahedron 16 along axis 38, between base 40 and apex 36, is also equal to the diameter of sphere 14. This dimensional relationship is aesthetically pleasing and promotes stability when the separate objects 12, 14 and 16 are stacked.

Each of objects 12, 14 and 16 has a different color, as well as shape, for signalling purposes. In the preferred embodiment, cube 12 is red, sphere 14 is yellow and tetrahedron 16 is green. Preferably, each of objects 12, 14 and 16 is made of the same material, preferably, a closed cell plastic having a relatively high density of approximately 0.12 ounces per cubic inch. The closed cell plastic has a relatively high static coefficient of friction with itself (approximately 0.4) to enable the sphere to be stably mounted on the cube and the pyramid to be stably mounted on the sphere. The coefficient of friction is sufficiently high and the depth of indentation 42 in base 40 of tetrahedron 16 is sufficient to enable the tetrahedron vertical axis 38 to be tilted approximately as much as 30° with respect to vertical axis 26 of cube 12 that intersects the nadir of indentation 24 and defines the cube center line. The static coefficient of friction between the common material forming each of cube 12, sphere 14 and tetrahedron 16 and the plastic surface of a typical computer workstation display is sufficiently high (also approximately 0.4) to enable the cube and pyramid, when the bases thereof are placed on the display sloping surface, to remain stably in situ. The bright colors of cube 12 and tetrahedron 16, when placed on a computer monitor of the cathode ray tube type, are in contrast to the neutral colors of the exterior surfaces of these monitors to assist in brightening what are frequently otherwise drab office environments.

Figure 7:
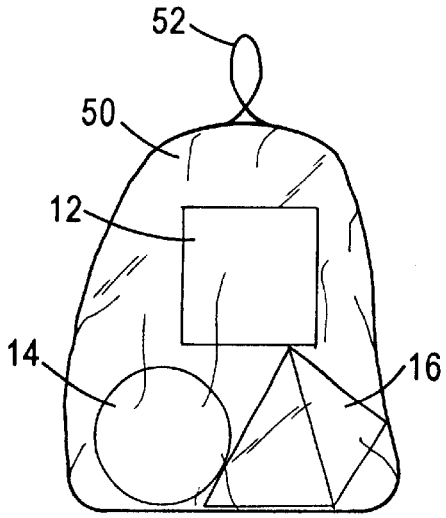
FIG. 7 is an illustration of the cube, sphere and tetrahedron illustrated in FIG. 1 in a string bag.
Figure 9:
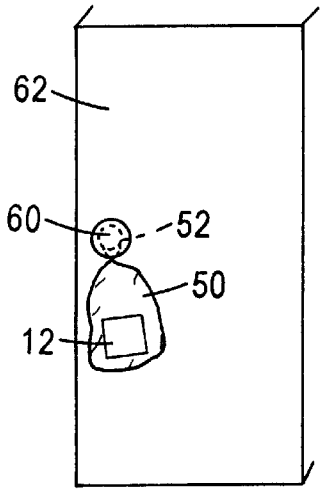
FIG. 9 is an illustration of another way the structure of FIG. 1, in combination with the string bag of FIG. 7, can be used for signalling purposes.

Cube 12, sphere 14 and tetrahedron 16, when originally packaged and purchased, are in string bag 50, FIG. 7. The density of the strings in string bag 50 is sufficiently low to enable the bag to be substantially optically transparent so cube 12, sphere 14 and tetrahedron 16 can be seen through the string bag. The string density is great enough to hold cube 12, sphere 14 and tetrahedron 16 without these objects falling through openings in the bag between the strings. The strings of string bag 50 are looped together to form hanger 52 at the top of the string bag.

A preferred use of the assembly including red cube 12, yellow sphere 14 and green tetrahedron 16 is for personal attitude characteristic signalling purposes, particularly in high density and other office environments. A worker displays red cube 12 more prominently than yellow sphere 14 or green tetrahedron 16 to signal to others, including his co-workers, that he is in a high state of concentration and is not to be disturbed. The worker more prominently displays yellow sphere 14 to signal to others that he can be interrupted but prefers not to be interrupted. Prominent display of green tetrahedron 16 signals the worker is open to conversation.

Figure 6:
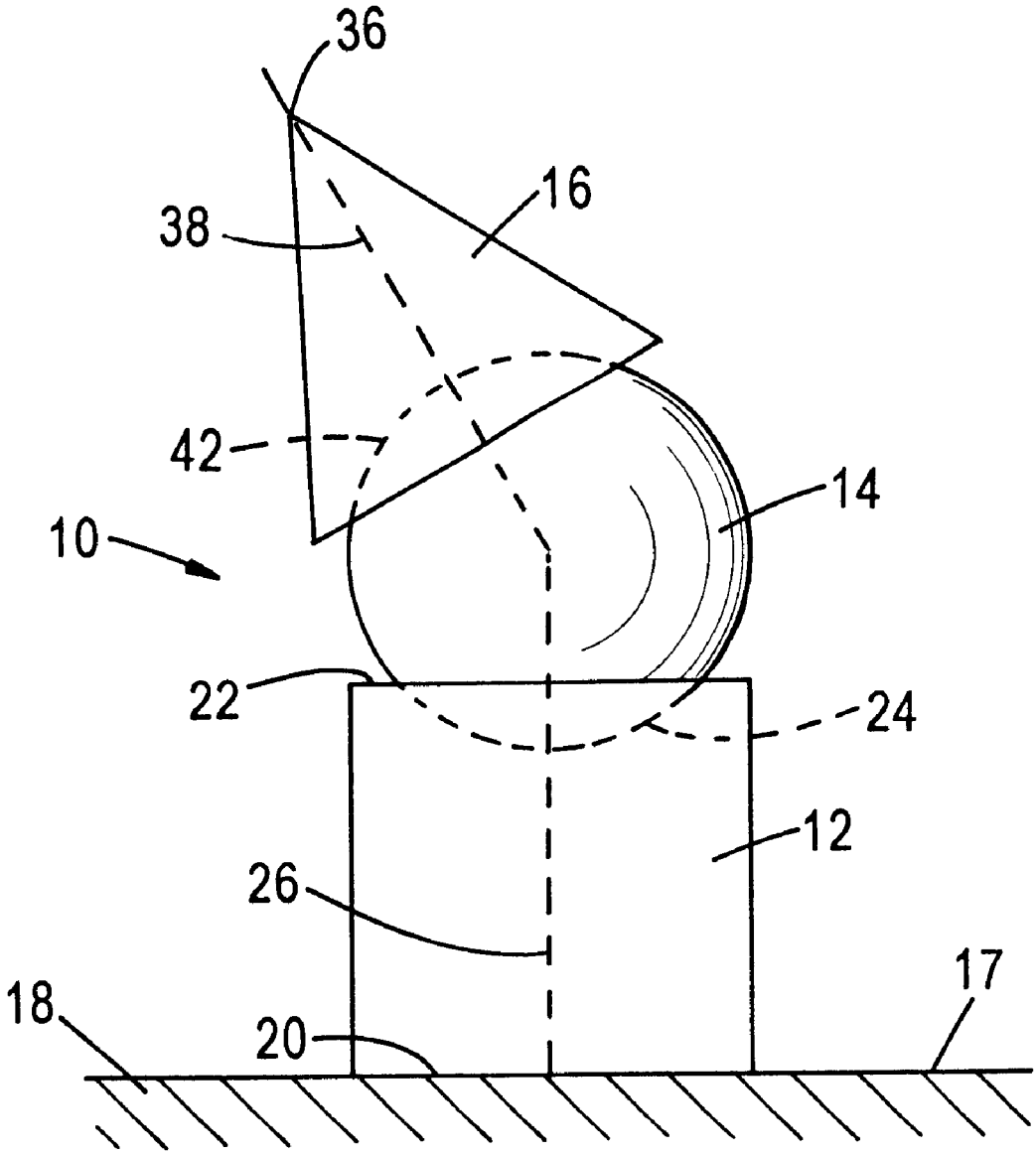
FIG. 6 is an elevation view of the structure illustrated in FIG. 1, with a vertical axis of the tetrahedron being tilted at an angle of approximately 30° from the vertical.

Cube 12, sphere 14 and tetrahedron 16 can be used separately or together for signalling purposes. For example, if the worker is open to be interrupted, he can stack the cube, sphere and tetrahedron as described supra and illustrated in FIGS. 1 and 4 or FIG. 6. Alternatively, if the worker is open to conversation, he can put tetrahedron 16 on the upper face of cube 12 or he can place the tetrahedron directly on support surface 17. In all three cases, if the worker is open to interruptions, the worker places green tetrahedron 16 in a more prominent place than sphere 14 or cube 12. For example, when the worker prominently displays tetrahedron 16, he can place cube 12 and sphere 14 in a desk drawer.

If the worker wishes to signal that he would prefer not to be interrupted but is willing to be interrupted, he places yellow sphere 14 in a more prominent location than either tetrahedron 16 or cube 12. For example, sphere 14 has a sufficiently high static coefficient of friction when placed on a horizontally disposed wooden or plastic desk support surface to remain statically in place. The sphere is also sufficiently resilient that it can be compressed somewhat to assist it in remaining stably in place on such a horizontally disposed surface. If only yellow sphere 14 is placed on the desk of the worker, the worker places cube 12 and tetrahedron 16 out of sight, e.g., in his desk drawer. Alternatively, yellow sphere 14 can be placed more prominently than green tetrahedron 16 and red cube 12 by placing the sphere in indentation 24 of cube 12, while cube 12 rests on the worker's desk and the tetrahedron is in the desk drawer.

If the worker does not want to be disturbed, he places cube 12 in a more prominent position than either sphere 14 or tetrahedron 16. Typically, the worker, in such an instance, places cube 12 on a generally horizontal surface such that indentation 24 is not revealed to an observer, whereby face 22 of cube 12 is placed on the surface. Usually, when red cube 12 is placed in a prominent place, the worker places sphere 14 and tetrahedron 16 out of sight, e.g., in a desk drawer.

Figure 8:
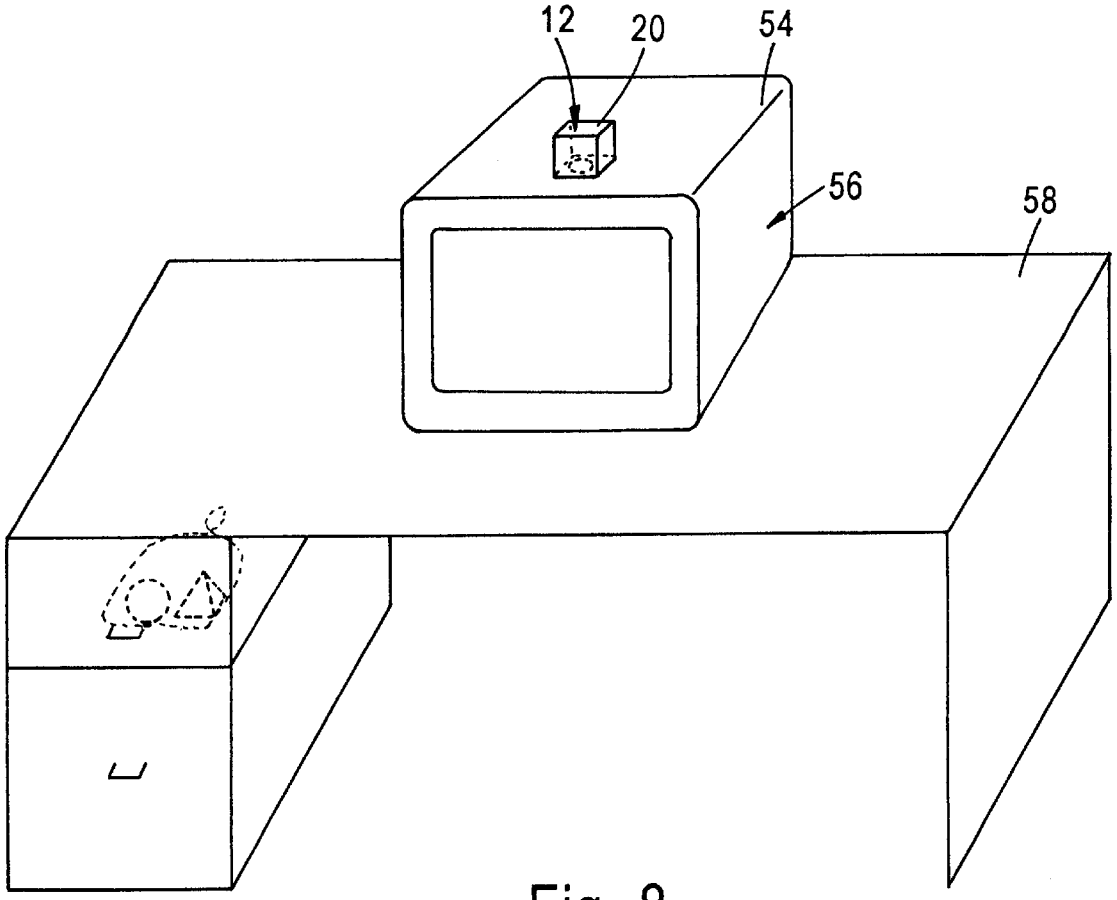
FIG. 8 is an illustration of one way the structure of FIG. 1 can be used for signalling purposes.

The coefficient of static friction of red cube 12 and green tetrahedron 16 are such that the cube and tetrahedron can be placed on sloping surface 54 of computer monitor 56 of the cathode ray tube type; monitor 56 is carried by desk 58, FIG. 8. Preferably, cube 12 is placed on surface 54 so that base 20 of the cube is in an upper position and face 22 bears against the surface 54 to hide indentation 24. By pressing downwardly on face 20, a slight suction effect occurs between indentation 24 and surface 54, to enhance the ability of cube 12 to remain in situ on surface 54. Tetrahedron 16 is preferably placed on surface 54 so the tetrahedron base contacts surface 54. Alternatively, the worker can signal that he is open to conversation by placing the complete stacked assembly comprising cube 12, sphere 14 and tetrahedron 16 on surface 54 so base 20 of cube 12 bears against surface 54. In such a configuration, the worker is likely to position tetrahedron 16 so its axis 38 is displaced from axis 26 of cube 12; e.g., axis 38 is vertically directed while axis 26 is displaced 30° from the vertical by virtue of a 30° slope of surface 34 from the horizontal.

The assembly comprising cube 12, sphere 14 and tetrahedron 16 is, to a certain extent, a cryptographic signalling device. Generally, visitors to offices containing the stacked arrangement of cube 12, sphere 14 and tetrahedron 16 will not realize the nature of the coded signals being conveyed by the visual appearance of these objects. Hence, a visitor will not be offended by seeing many "do not disturb" signs in place.

Red cube 12, yellow sphere 14 and green tetrahedron 16 can be used in combination with string bag 50 to signal whether a worker is unwilling to receive others, is possibly open to receive others and is interested in receiving others. In particular, one of the red cube, yellow sphere and green tetrahedron can be placed in string bag 50, as appropriate. A worker hangs string bag 50 on doorknob 60 of door 62 by hanger 52 for signalling purposes. If a worker in a room including door 62 closes the door with red cube 12 in string bag 50 hanging from doorknob 60, a person about to barge into the room by turning doorknob 60 realizes that the worker in the room is not to be disturbed and does not barge into the room. Similarly, the worker in the room can place either sphere 14 or tetrahedron 16 in string bag 50 which he then hangs on doorknob 60 by placing. the looped strings forming hanger 52 about the doorknob.

The assembly of objects can also be used to enhance teamwork in the workplace. For example, any of objects 12, 14 or 16, and in particular sphere 14, can be tossed among co-workers at a meeting to instill a feeling of cooperation as well as to break tension. Also, if a worker in a high density workspace environment desires to signal to others in his vicinity that his attempts to concentrate are being prevented by his neighbors, he can toss red cube 12 over a partition separating him from his neighbors who are engaged in interruptive behavior.

While there have been described and illustrated specific embodiments of the invention, it will be clear that variations in the details of the embodiments specifically illustrated and described may be made without departing from the true spirit and scope of the invention as defined in the appended claims.

We claim:

1. A stack of objects on a substantially flat horizontal support surface comprising first, second and third separate objects, the first object having a base and a face substantially parallel to the base, the second object having a base and a side wall tapered to an apex, and a third object having a curved outer surface, the base of the first object stably resting on the horizontal support surface, the objects being sized, shaped and arranged so the third object rests stably without other support on the face of the first body and the base of the second object rests stably without other support on the third body, the face of the first object having a concave indentation stably receiving a first portion of the curved surface of the third object so the first portion of the curved surface of the third object nests on the concave indentation of the first body, and the base of the second object having a concave indentation stably nesting on a second portion of the curved surface of the third body.

2. The stack of claim 1, wherein each of the objects is coded to have differing shapes and colors, the shapes and colors of the objects enabling a human subject to signal different personal attitude characteristics to others.

3. The stack of claim 1, wherein the objects are made of a closed foam compressible plastic.

4. A stack of objects on a substantially flat horizontal support surface comprising first, second and third separate objects, the first object having a base and a face substantially parallel to the base, the second object having a base and a side wall tapered to an apex, and a third object having a curved outer surface, the base of the first object stably resting on the horizontal support surface, the objects being sized, shaped and arranged so the third object rests stably without other support on the face of the first body and the base of the second object rests stably without other support on the third body, the third object being a sphere, the face of the first object having a concave indentation that is a sector of a sphere having substantially the same curvature as the sphere forming the third object, the base of the second object having a concave indentation that is a sector of a sphere having substantially the same curvature as the sphere forming the third object, the first, second and third objects being arranged so the sphere forming the third object nests on the indentation of the first object in such a way that there is substantial contact between the surfaces of the sphere forming the third object and the indentation of the first object and the indentation of the second object nests on the sphere forming the third object in such a way that there is substantial contact between the surfaces of the sphere forming the third object and the indentation of the second object.

5. The stack of claim 4 wherein the second object is shaped as a tetrahedron.

6. The stack of claim 5, wherein the sphere forming the third object and the tetrahedron are made of the same material having a relatively high coefficient of static friction with itself, the size and shape of the sphere forming the third object and the tetrahedron and the coefficient of friction being such that the tetrahedron vertical axis is displaced approximately 30° from the vertical.

7. The stack of claim 5, wherein the tetrahedron base is shaped as a square having sides about equal in length to the diameter of the sphere forming the third object, the tetrahedron having a height approximately equal to the diameter of the sphere forming the third object.

8. The stack of claim 7, wherein the first object is shaped as a cube having sides approximately equal in length to the sphere diameter.

* * * * *